US007780746B2

(12) United States Patent
Macpherson et al.

(10) Patent No.: US 7,780,746 B2
(45) Date of Patent: Aug. 24, 2010

(54) ADDITIVES AND LUBRICANT FORMULATIONS FOR IMPROVED USED OIL COMBUSTION PROPERTIES

(75) Inventors: Ian Macpherson, Richmond, VA (US); Allen A. Aradi, Glen Allen, VA (US); David Cleaver, Chesterfield, VA (US)

(73) Assignee: Afton Chemical Corporation, Richmond, VA (US)

( * ) Notice: Subject to any disclaimer, the term of this patent is extended or adjusted under 35 U.S.C. 154(b) by 880 days.

(21) Appl. No.: 11/534,314

(22) Filed: Sep. 22, 2006

(65) Prior Publication Data

US 2008/0076685 A1 Mar. 27, 2008

(51) Int. Cl.

| | |
|---|---|
| ***C10L 1/12*** | (2006.01) |
| ***C10L 1/18*** | (2006.01) |
| ***C07F 7/22*** | (2006.01) |
| ***C08K 5/58*** | (2006.01) |

(52) U.S. Cl. ..... 44/355; 44/354; 44/364; 508/382; 508/383

(58) Field of Classification Search ..... 508/382, 508/383; 44/354, 355, 364
See application file for complete search history.

(56) References Cited

U.S. PATENT DOCUMENTS

| | | | | |
|---|---|---|---|---|
| 2,818,417 | A | 12/1957 | Brown et al. | |
| 3,348,932 | A | 10/1967 | Kukin | |
| 5,204,012 | A | 4/1993 | Schaffhausen | |
| 5,405,417 | A | 4/1995 | Cunningham | |
| 6,034,040 | A | 3/2000 | Ozbalik et al. | |
| 7,332,001 | B2 | 2/2008 | Guinther et al. | |
| 2003/0183178 | A1 * | 10/2003 | Caprotti et al. | 123/1 A |
| 2004/0110104 | A1 | 6/2004 | Guinther et al. | |
| 2004/0254081 | A1 * | 12/2004 | Guinther et al. | 508/371 |
| 2005/0091913 | A1 | 5/2005 | Aradi et al. | |
| 2005/0108923 | A1 | 5/2005 | Factor et al. | |

* cited by examiner

*Primary Examiner*—Walter D Griffin
*Assistant Examiner*—Frank C Campanell
(74) *Attorney, Agent, or Firm*—Luedeka, Neely & Graham, PC

(57) ABSTRACT

The disclosure is directed to a method of enhancing a fuel value for a used or waste lubricating oil, lubricating oils having improved combustion and emission characteristics, and a business method for distributing and using waste oils as components of primary combustion fuels. In one embodiment, there is provided a lubricating oil composition having improved combustion and emission properties when burned as a used lubricating oil composition. The lubricating oil composition includes a major amount of oil of lubricating viscosity and a minor combustion improving amount of a combustion improving additive.

13 Claims, 3 Drawing Sheets

ADDITIVES AND LUBRICANT FORMULATIONS FOR IMPROVED USED OIL COMBUSTION PROPERTIES

TECHNICAL FIELD

The disclosure relates to methods and compositions for improving fuel values of used or waste lubricating oils. Specifically, the methods and compositions relate to the application of combustion improving and emissions lowering additive compounds to the lubricant or oil prior to use so that a fuel value of the lubricant or oil may be increased upon subsequent combustion thereof as a component of a combustion fuel being burned.

BACKGROUND AND SUMMARY

A wide variety of lubricating oils are prepared and used in many different applications. Such lubricating oils require replacement over time once they meet their useful life expectancy. In some instances, the lubricating oils may be reprocessed by re-refiners to provide useful lubricants. However, for many applications, the lubricating oils have very little value or may be too contaminated to reprocess efficiently and thus are burned in incinerators as a means of disposal.

As sources of energy tighten globally, the use of used oil as a fuel source is becoming a more viable option for replacement or supplementation of other fuel sources. Waste or used oils, however, typically have low fuel value. Accordingly, there is a need for new uses for waste lubricating oils that may provide an increased value for an otherwise low value commodity.

The disclosure is directed to a method of enhancing a fuel value for a used or waste lubricating oil, lubricating oils having improved combustion and emission characteristics, and a business method for distributing and using waste oils as components of primary combustion fuels. In one embodiment, there is provided a lubricating oil composition having improved combustion properties when burned as a used lubricating oil composition. The lubricating oil composition includes a major amount of oil of lubricating viscosity and a minor combustion improving amount of a combustion improving additive.

Another exemplary embodiment provides a method for improving a fuel value of a used lubricating oil. The method includes combining a combustion improving amount of a combustion improving additive with an oil of lubricating viscosity and using the oil of lubricating viscosity.

Yet another exemplary embodiment provides a method of doing business. According to the methods, an oil of lubricating viscosity is leased to a user. The oil of lubricating viscosity contains a combustion improving amount of combustion improving additive. Used oil is collected from the user and sold as a fuel component.

Another embodiment provides a method for reducing the vapor pressure of an organometallic additive concentrate. The method includes formulating a used oil of lubricating viscosity with an amount of organometallic additive sufficient to provide from about 0.1 to about 10,000 ppm total metal to the additive concentrate. The resulting additive concentrate has a vapor pressure of less than about 0.0005 torr at 20° C. and less than about 0.50 torr at about 120° C.

An advantage of embodiments of the disclosure is that lubricants and oils typically having low fuel values may be greatly enhanced before use so that upon replacement of the lubricants, the lubricants may be used as an alternative fuel source. The embodiments also provide a unique method of providing increased value for lubricants used in industrial applications by providing a leasing rather than sales model that enables the lessor to reclaim the lubricant periodically and sell the lubricant for fuel value. A further benefit of the disclosed embodiments is that, compared to burning lubricants devoid of the combustion improving additive, lubricant compositions as described herein may have increased emissions lowering properties. Another advantage of the compositions and method described herein is that organometallic additive concentrates may be provided that have relatively low vapor pressures thereby improving the handling and storage capabilities of such additive concentrates.

BRIEF DESCRIPTION OF THE DRAWINGS

Further features and advantages of the disclosed embodiments may become apparent by reference to the detailed description when considered in conjunction with the figures wherein.

DETAILED DESCRIPTION OF EMBODIMENTS

Figure 1:
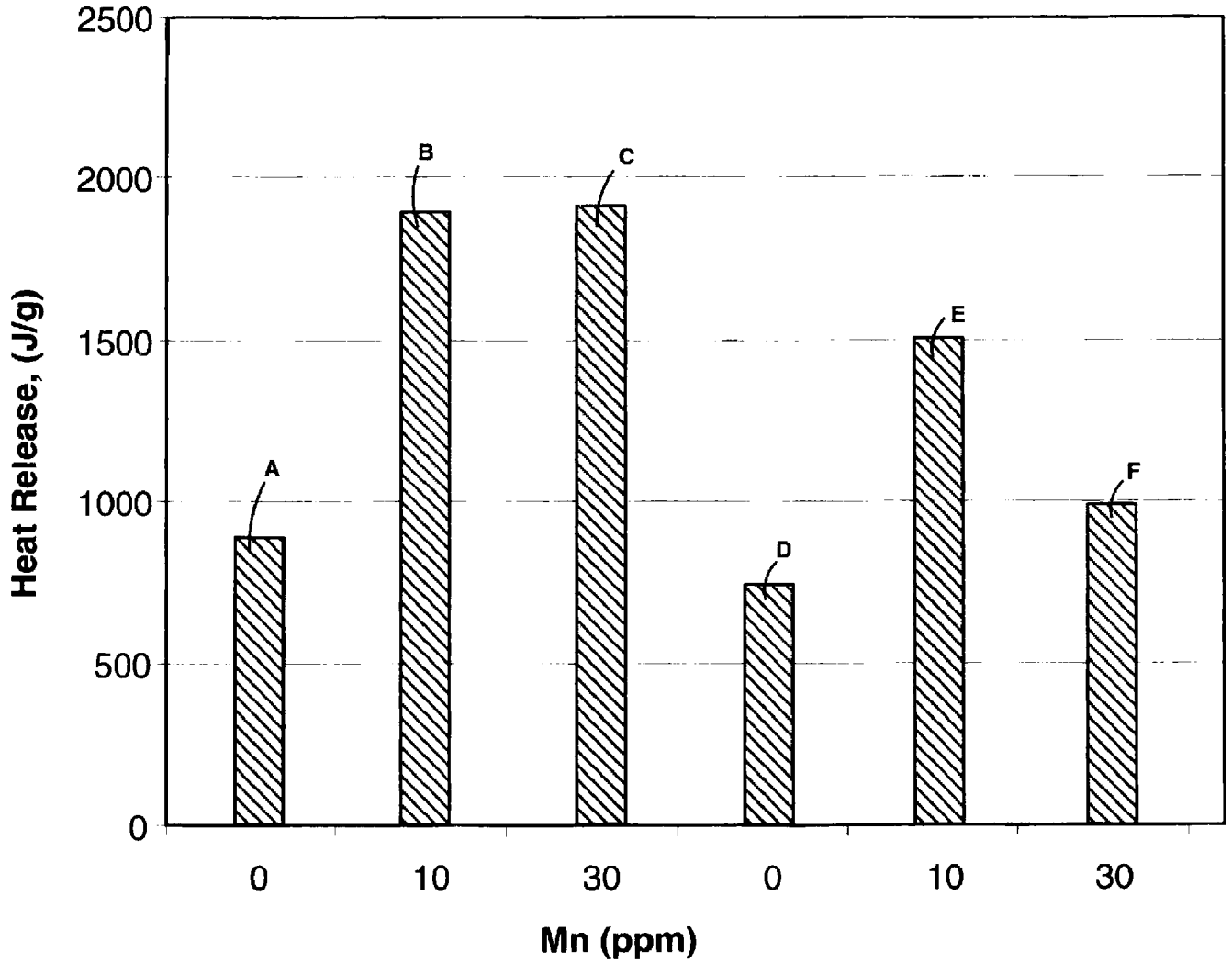
FIG. 1 is a heat release energy plot derived from a differential scanning calorimeter at temperatures ranging from about 225° C. to about 325° C. versus metal concentration in lubricants for new and used oils containing from zero to thirty ppm of a combustion improving additive according to the disclosure.

For the purposes of this disclosure, the term "hydrocarbon soluble" means that the compound is substantially suspended or dissolved in a hydrocarbon material, as by reaction or complexation of a manganese compound with a hydrocarbon material, and the resultant solution is substantially stable at ambient conditions for extended periods of time. As used herein, "hydrocarbon" means any of a vast number of compounds containing carbon, hydrogen, and/or oxygen and other heteroatoms, i.e., sulfur, nitrogen, phosphorus, and halogens, in various combinations.

The term "hydrocarbyl" refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(ii) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(iii) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, typically no more than one, non-hydrocarbon substituent will be present for every ten carbon atoms in the hydrocarbyl group; typically, there will be no non-hydrocarbon substituents in the hydrocarbyl group.

An important component of compositions according to the disclosure is a combustion improving compound, composition, or component that is added to a lubricant or oil before use and that is soluble in a lubricant or fuel. Such compositions or compounds may include one or more of the compounds or components typically used in fuels to increase the combustion efficiency of the fuels. Such compositions or compounds may include, but are not limited to, oganometallic compounds, nitrates, cerium oxidic compounds, peroxy ester derivatives as described in U.S. Pat. No. 5,405,417, and iron, manganese, and copper admixed with compounds of lead, cobalt, nickel, chronium, antimony, tin, and vanadium as described in U.S. Pat. No. 3,348,932.

Other suitable combustion improving additives may include, but are not limited to compounds, mixtures, and/or alloys containing one or more of lithium, sodium, potassium, calcium, strontium, barium, chromium, manganese, iron, copper, cobalt, ruthenium, rhodium, palladium, osmium, platinum, lanthanum, cerium, or iridium that are soluble in the lubricant or fuel. A particularly useful combustion improving additive is an organo-metallic compound suitable for improving the combustion and emission characteristics of used lubricating oil compositions. The ogano-metallic compound may be selected from metal tricarbonyl compounds, such as manganese tricarbonyl compounds. Suitable manganese tricarbonyl compounds which may be used according to the disclosed embodiments include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Particularly suitable are the cyclopentadienyl manganese tricarbonyls which are liquid at room temperature such as methylcyclopentadienylmanganesetricarbonyl, ethylcyclopenta-dienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc.

Preparation of such compounds is described in the literature, for example, U.S. Pat. No. 2,818,417, the disclosure of which is incorporated herein in its entirety.

When formulating lubricating oil compositions to improve the combustion and emission properties thereof, the organometallic compounds (e.g., cyclopentadienyl manganese tricarbonyl compounds) are employed in amounts sufficient to increase the fuel value of the lubricating oil compositions and/or to reduce soot emissions during burning of the lubricating oil composition compared to compositions devoid of the ogano-metallic compounds. Thus the lubricating oil compositions described herein may contain minor amounts of the organo-metallic compounds. Generally speaking, the lubricating oil compositions may contain an amount of the organometallic compound sufficient to provide from about 0.1 to about 100 ppm of total elemental metals in a fuel containing the lubricating oil composition, and typically from about 1.0 to about 50 ppm of total elemental metals in the fuel containing the lubricating oil composition.

For example, a lubricating oil composition may contain from about 0.1 to about 100 ppm of the combustion improving additive when used as a component of a fuel composition wherein the fuel composition contains from 50 weight percent or more of the lubricating oil composition plus additive. Likewise, a lubricating oil composition may contain from about 100 to about 1000 ppm of the combustion improving additive when used as a component of a fuel composition wherein the fuel composition contains from about 5 to about 50 weight percent of the lubricating oil composition plus additive.

Lubricating oil compositions containing a combustion improving amount of the ograno-metallic compounds described above may be used in a wide variety of applications. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, machine oils, gear oils, hydraulic oils, rolling mill oils, transmission oil, and the like.

Depending on the application, the lubricants may be essentially base oil lubricants containing the combustion improver described above, or fully formulated lubricants that contain conventional an additive packages that supply the characteristics that are required in the formulations. Additive packages may include dispersant/detergent packages, referred to herein as DI packages. Suitable DI packages are described for example in U.S. Pat. Nos. 5,204,012 and 6,034,040 for example. Among the types of additives included in the additive package may be dispersants, friction modifiers, seal swell agents, antioxidants, foam inhibitors, lubricity agents, rust inhibitors, corrosion inhibitors, demulsifiers, viscosity index improvers, and the like. Several of these components are well known to those skilled in the art and are generally used in conventional amounts with the additives and compositions described herein.

Examples of usable base oil for lubricating oils include mineral oils and synthetic oils. The term mineral oils used here means those obtained from crude oil through separation, distillation and purification, and includes paraffinic oils, naphthenic oils, their hydrogenated oils, their purified oils, and hydrogenolyzed very high viscosity index oils. The term synthetic oils used here means chemically synthesized lubricating oils, and include poly-alpha-olefins, polyisobutylene or polybutene, diesters, polyol esters, phosphate esters, silicate esters, polyalkyleneglycols, polyphenylethers, silicones, fluorides, alkylbenzene and the like.

Examples of suitable synthetic lubricating base oils include alpha-olefinic polymers having 3 to 12 carbon atoms, e.g. alpha-olefinic oligomers; dialkyl diesters having 4 to 12 carbon atoms, e.g. sebacates, such as 2-ethylhexyl sebacate and dioctyl sebacate, azelates, and adipates; polyol esters, e.g. esters obtained by the reaction of trimethylolpropane or pentaerythritol with monobasic acids having 3 to 12 carbon atoms; alkylbenzenes having 9 to 40 carbon atoms; polyglycols obtained by condensation of butyl alcohol with propylene oxide; and phenyl ethers having 2 to 5 ether sequences and 3 to 6 phenylene segments. The mineral and synthetic lubricating base oils may be used alone or in combination. The amount of the base oil to be compounded is adequately determined depending on required properties and is generally 70 to 95 wt % of the fully formulated base oil.

Any well known additives can be incorporated in the base oils to provide lubricants having improved combustion properties as described herein. Examples of such additives include friction reducers, e.g. higher fatty acids, higher alcohols, amines, and esters; sulfur-containing, chlorine-containing, phosphorus-containing, and organometallic extreme pressure agents; phenolic and amine antioxidants; neutral or highly basic alkaline earth metal sulfonates; carboxylate detergents; dispersants, e.g. succinic imide and benzyl amine; viscosity index improvers, e.g. high molecular weight poly(meth)acrylates, polyisobutylenes, polystyrenes, ethylene-propylene copolymers, and styrene-isobutylene copolymers; ester and silicone antifoaming agents; corrosion inhibitors; and flow-point decreasers. One or more or the foregoing additives may be used in an amount within a customary range for the particular lubricant application.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

The combustion improving additive may be added directly to the lubricating oil composition. In one embodiment, however, the combustion improving additive is diluted with a substantially inert, normally liquid organic diluent such as mineral oil, synthetic oil, naphtha, alkylated (e.g. $C_{10}$-$C_{13}$ alkyl) benzene, toluene or xylene to form an additive concentrate. These concentrates usually contain from about 1% to about 100% by weight and in one embodiment about 10% to about 90% by weight of the combustion improving additive.

After use, the used or waste lubricants may be contaminated with a variety of components that make the oils undesirable for their originally intended use. Accordingly, the lubricants may be reprocessed to remove the contaminants and reformulate the lubricants to meet the application criteria for the lubricant, or the lubricants containing a combustion improving amount of combustion improver may be burned for their fuel value.

By way of non-limiting example, lubricants containing the combustion improver according to the disclosure may be burned as a component of a fuel composition in asphalt plants, space heaters, industrial boilers, utility boilers, steel mills, cement kilns, marine boilers, pulp and paper mills, incinerators, and commercial boilers. Many of the foregoing applications also include pollution control equipment such as bag houses, electrostatic precipitators, scrubbers, and the like. For example, lubricants and oils containing combustion improvers according to the disclosure may be burned in asphalt hot mix plants wherein the combustion gases have intimate contact with asphalt products such that pollutants are partially absorbed by the products.

Figure 2:
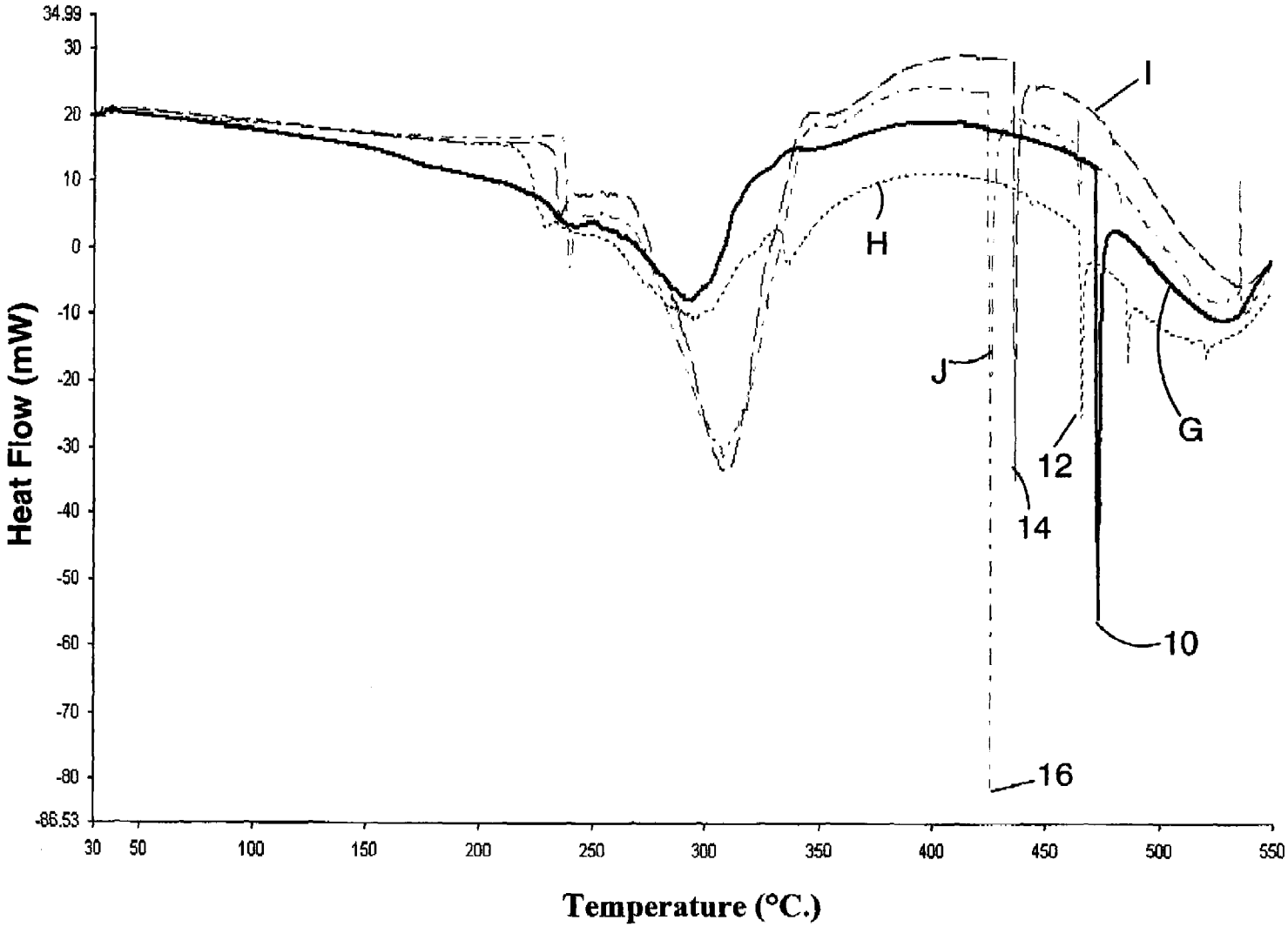
FIGS. 2 and 3 are heat flow spectra events for new and used lubricants containing combustion and emission improving additives according to the disclosure showing curve peak temperature shifts due to the additive.
Figure 3:
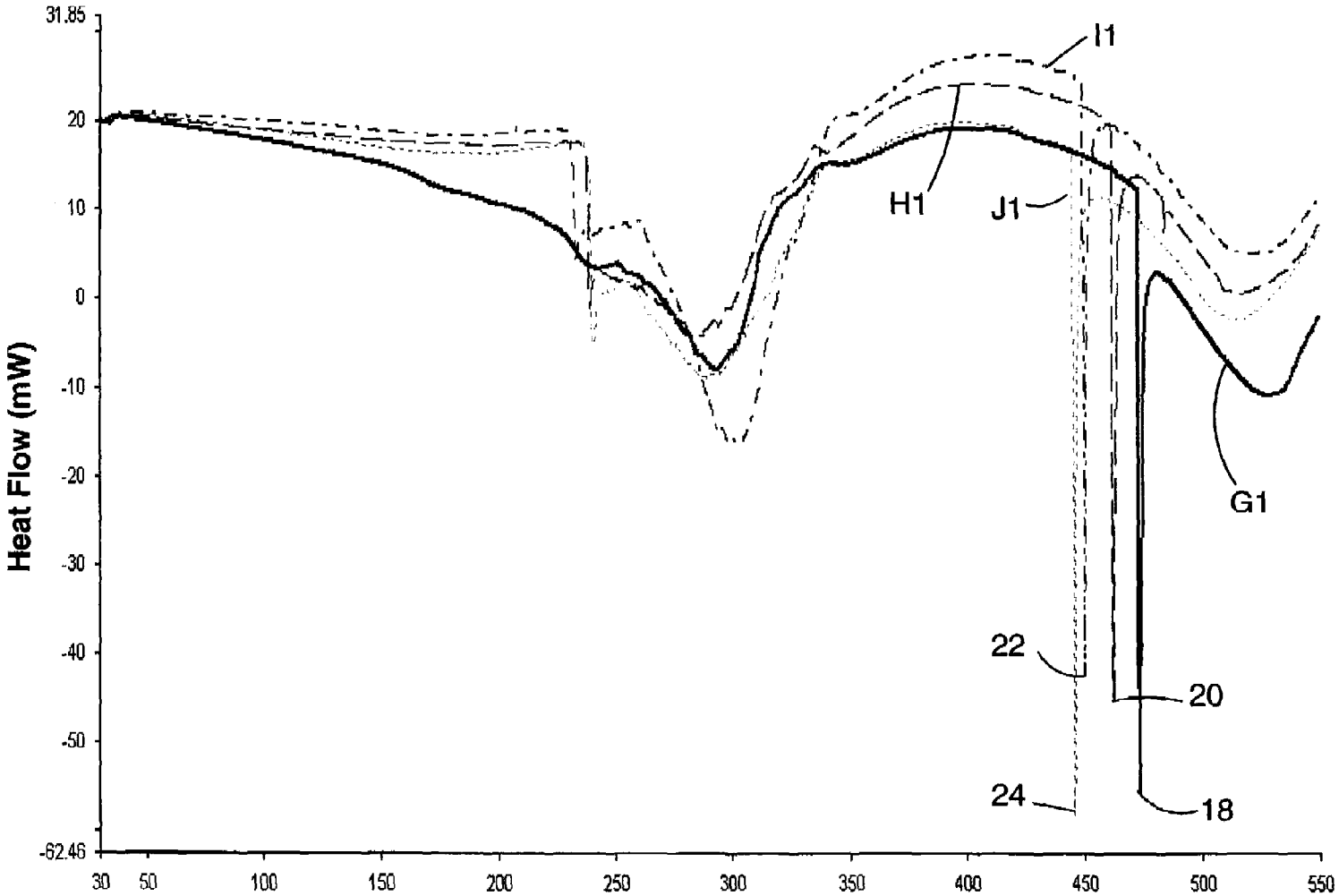

An example of the benefits of the combustion improving additive in a hydraulic oil composition is illustrated in FIGS. 1, 2 and 3. FIG. 1 illustrates differential scanning calorimeter (DSC) heat energy release for a hydraulic oil and solvent with and without a manganese combustion improving additive. Peaks A, B, and C represent the heat energy release for a new hydraulic oil containing 0, 10 and 30 ppm manganese from a methylcylopentadienyl manganese tricarbonyl (MMT®) combustion improving additive, and Peaks D, E, and F represent the heat energy release of the hydraulic oil after 150 hours of use containing 0, 10, and 30 ppm manganese from an MMT® additive. The heat release energy is an indication of the rate of combustion of the lubricant and solvent as a fuel. Peaks B and C indicate a greater energy release for a new oil containing 10 or 30 ppm manganese compared to the oil devoid of the combustion improving additive (Peak A). A similar result of an increase in heat energy release for a used oil is indicated by Peaks E and F which are greater than Peak D, the used oil devoid of the combustion improving additive. As illustrated, an optimum heat energy release may be obtained when the used oil contains from about 5 to about 25 ppm manganese from the combustion improving additive.

In FIGS. 2 and 3 are plots of heat flow versus temperature for new and used hydraulic oils, respectively, showing a shift toward lower temperatures for lubricants containing the combustion improving additive. A shift to lower temperatures correlates with a reduction in emission of particulates and smoke upon combustion of the lubricants as fuels. Curve G in FIG. 2 is an unused hydraulic oil devoid of the combustion improving additive. Curve H is an unused hydraulic oil plus solvent devoid of the combustion improving additive. Curve I is the hydraulic oil plus solvent and 10 ppm manganese from the MMT® combustion improving additive. Curve J is the hydraulic oil plus solvent and 30 ppm manganese from the MMT® combustion improving additive. FIG. 3 are the same oils G1, H1, I1, and J1 of FIG. 2 after 150 hours use.

As seen in FIG. 2, the new oil and the new oil plus solvent (Curves G and H) have higher temperature peaks (10 and 12) than the peaks (14 and 16) for the new oil containing the combustion improving additive (Curves I and J). The same shift to lower temperatures is illustrated in FIG. 3 for the oils G1, H1, I1, and J1 after 150 hours of use. Peaks 22 and 24 are at a lower temperature than peaks 18 and 20. Accordingly, FIGS. 2 and 3 demonstrate that the combustion improving agent may be effective to reduce emissions from burning both new and used lubricants containing the combustion improving agent.

In another embodiment, the disclosure provides a method of conducting a business of providing lubricants for various applications wherein the lubricants are leased rather than sold to users. In this embodiment, a distributor delivers a lubricant containing a combustion improver to a user for a predetermine period of time at a least price. The lease price of the lubricant is determined to be somewhat less than a rate to purchase and then dispose of used or waste lubricant. Upon reaching a predetermined life cycle for the lubricant, the lubricant is returned to the distributor who then offers the lubricant for sale to a buyer that will burn the lubricant for its fuel value. In this way, a higher percentage of used lubricant may be recovered and sold for fuel value. If all of the lubricant is not returned to the distributor, the user is charged for any non-returned lubricant at the rate the lubricant could have been sold. Hence, the distribution method described above encourages complete recovery and return of used or waste oil to the distributor.

Yet another embodiment of the disclosure provides an improved method for handling and storing organometallic additive concentrates. The methods and compositions described herein may provide a relatively low vapor pressure carrier fluid for organometallic additives that are otherwise toxic in the vapor phase. Such additives may find use in the power generation utility industry as combustion improvers, slag/fouling deposit modifiers, corrosion inhibitors and emission control agents, but their value is typically diminished in that storage and handling may requires special permits, special storage and dispensation equipment, and dedicated trained personnel to handle the additive concentrates. Additional expenditures and procedures for handling conventional organometallic additive concentrates may dissuade a potential end-user from using the additive concentrate. Significant safety problem are associated with volatile and relatively high vapor pressure solvents used as carrier fluids for the conventional organometallic additive concentrates. As the volatile components of the additive concentrate vaporize, the toxic organometallic additive may be drawn into the vapor phase by aspiration creating a toxic vapor that may be inhaled by nearby personnel.

However, additive concentrates according to the disclosed embodiments may have relatively low vapor pressures. For example, the used lubricating oils used for making the additive concentrates containing organometallic compounds described herein may have vapor pressures of less than about 0.001 torr at 20° C. and less than about 1.0 torr at about 120° C. as a result of aging or use of the lubricating oils. Accordingly, additive concentrates made with such used lubricating oils may also have correspondingly low vapor pressures. Unused oils typically have higher vapor pressures than the used oils. Accordingly, the disclosure may provide organometallic concentrates that may be handled and stored with greater ease than conventional organometallic concentrate additive.

It is to be understood that the reactants and components referred to by chemical name anywhere in the specification or claims hereof, whether referred to in the singular or plural, are identified as they exist prior to coming into contact with another substance referred to by chemical name or chemical type (e.g. base oil, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the organometallic compound) or in forming a desired composition (such as an additive concentrate or additized lubricant composition). It will also be recognized that the additive components can be added or blended into or with the base oils individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

At numerous places throughout this specification, reference has been made to a number of U.S. patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A fuel composition comprising fuel and from about 5 weight percent up to about 95 weight percent of a lubricating oil composition having improved combustion and emission lowering properties when burned as a used lubricating oil composition in the fuel composition, the lubricating oil composition comprising an oil of lubricating viscosity and from about 0.1 to about 1000 ppm total metal from a combustion improving additive.

2. The fuel composition of claim 1, wherein the oil of lubricating viscosity comprises an oil selected from the group consisting of machine oils, gear oils, hydraulic oils, rolling mill oils, transmission oil, crankcase oils, and the like.

3. The fuel composition of claim 2, wherein the oil is contaminated with water.

4. The fuel composition of claim 2, wherein the oil of lubricating viscosity is contaminated with wear products from lubricated surfaces.

5. The fuel composition of claim 1, wherein the combustion improving additive comprises a component selected from the group consisting of lithium, sodium, potassium, calcium, strontium, barium, chromium, manganese, iron, copper, cobalt, ruthenium, rhodium, palladium, osmium, platinum, lanthanum, cerium, iridium, mixtures of two or more of the foregoing, and alloys of two or more of the foregoing.

6. The fuel composition of claim 1, wherein the combustion improving additive comprises a manganese tricarbonyl compound.

7. The fuel composition of claim 6, wherein the manganese tricarbonyl compound comprises a compound selected from the group consisting of cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, and indenyl manganese tricarbonyl.

8. The fuel composition of claim 7, wherein the manganese tricarbonyl compound comprises cyclopentadienyl manganese tricarbonyls which are liquid at room temperature selected from the group consisting of methylcyclopentadienylmanganesetricarbonyl, ethylcyclopentadienyl manganese tricarbonyl, mixtures of cyclopentadienyl manganese tricarbonyl and methylcyclopentadienyl manganese tricarbonyl, and mixtures of methylcyclopentadienyl manganese tricarbonyl and ethylcyclopentadienyl manganese tricarbonyl.

9. The fuel composition of claim 1, wherein the lubricating oil is contaminated with rolling mill oil.

10. The fuel composition of claim 1, wherein the lubricating oil has a vapor pressure of less than about 0.001 torr at 20° C. and less than about 1.0 torr at about 120° C.

11. The fuel composition of claim 1, comprising from about 50 weight percent up to about 95 weight percent of the lubricating oil composition, wherein the lubricating oil composition comprises from about 0.1 to about 100 ppm total metal from the combustion improving additive.

12. The fuel composition of claim 1, comprising from about 5 weight percent up to about 50 weight percent of the lubricating oil composition, wherein the lubricating oil composition comprises from about 100 to about 1000 ppm total metal from the combustion improving additive.

13. The fuel composition of claim 1, wherein the fuel composition contains from about 0.1 to about 100 ppm total metal from the combustion improving additive.

* * * * *